US005125327A

United States Patent [19]

Winnington-Ingram

[11] Patent Number: 5,125,327

[45] Date of Patent: Jun. 30, 1992

[54] BEVERAGE POT

[76] Inventor: Francis C. Winnington-Ingram, 46 Grandison Road, London SW11 6LW, England

[21] Appl. No.: 599,147

[22] Filed: Oct. 17, 1990

[51] Int. Cl.[5] ..... A47G 19/16

[52] U.S. Cl. ..... 99/306

[58] Field of Search ..... 99/279, 295, 306, 316, 99/317, 318, 319, 323, 238, 470; 210/481; 426/433; 220/912, 23.83, 23.86

[56] References Cited

U.S. PATENT DOCUMENTS

| | | | |
|---|---|---|---|
| 918,674 | 4/1909 | Hathaway | 99/317 |
| 1,038,558 | 9/1912 | Gardner | 99/319 |
| 1,366,824 | 1/1921 | Nicholls | 99/319 |
| 1,549,043 | 8/1925 | Meyer | 99/319 |
| 2,285,833 | 6/1942 | Platt . | |
| 2,319,511 | 5/1943 | Neshaim | 99/323 |
| 3,182,584 | 5/1965 | Serio | 99/319 |
| 4,832,845 | 5/1989 | Hendretti | 99/306 |

FOREIGN PATENT DOCUMENTS

| | | | |
|---|---|---|---|
| 207093 | 11/1923 | United Kingdom . | |
| 239318 | 9/1925 | United Kingdom . | |
| 281191 | 12/1927 | United Kingdom . | |
| 323425 | 1/1930 | United Kingdom . | |
| 601634 | 5/1948 | United Kingdom | 99/316 |
| 2156662 | 10/1985 | United Kingdom . | |

*Primary Examiner*—Harvey C. Hornsby
*Assistant Examiner*—Reginald L. Alexander
*Attorney, Agent, or Firm*—Ostrolenk, Faber, Gerb & Soffen

[57] ABSTRACT

A teapot has a body with a spout and handle. An infuser of an injection moulded skeletal structure of plastics material and a porous wall is inserted into a teapot in order to carry tea leaves in a lower region of the pot for infusion. The infuser has a handle which rests in a cut out in the teapot lid seat, and a cut out in its own upper wall area to accommodate a retaining tongue of the lid.

2 Claims, 2 Drawing Sheets

BEVERAGE POT

This invention relates to a pot for preparing and dispensing a beverage. The invention relates particularly, but not exclusively to a teapot.

Generally speaking tea is brewed in a pot using one of two alternative procedures. In the first procedure loose tea particles are placed in a pot with boiling water and allowed to stand. The process of infusion then takes place and the boiling water takes up flavor from the leaves. The tea is then poured for drinking. Although teapot spouts incorporate a course filter, a separate strainer is usually required to keep spent tea leaves out of the drinking vessel. To avoid the inconvenience of the strainer with the use of loose tea the well known "tea bags" are also used; each bag comprises a dosage of tea within a permeable envelope. Amongst the discerning, however, it is though that tea bags are not as satisfactory from the flavor point of view as loose tea.

It is an objective of the present invention to provide an improved beverage pot which allows loose tea to be infused but prevents spent tea leaves from leaving the pot with the stream of brewed tea.

According to the present invention there is provided a beverage pot comprising a body to hold hot liquid and to permit the dispensing of the beverage therefrom, a lid providing access to the interior of the body and seated on a lid seat of the pot, an infuser with a porous wall for confining loose beverage particles, said infuser being formed of a skeletal wall structure of plastics material carrying a mesh to form the porous wall, having a shoulder resting on the lid seat and extending to the bottom region of the beverage pot to enable liquid in the lower region of the pot to contact the beverage particles through the porous wall.

Preferably the beverage pot lid has a retaining tongue which projects under the lid seat to prevent the lid from falling off during pouring, and the infuser shoulder has a cutout to accommodate said tongue.

It is convenient for the infuser to have a projecting handle extending out from the shoulder to permit the infuser to be lifted out of the pot, and for the lid seat of the beverage pot to have a cutout to accommodate the projecting handle.

In a preferred embodiment, the infuser is formed of a frusto-conical shape. This shape, in relation to a bulbous shaped pot of the kind illustrated, enables an efficient relationship between the liquid inside and outside of the infuser. Such an efficient relationship helps the process of brewing of the tea. Still further, the frusto-conical shape facilitates removal of the infuser.

In use, the infuser rests with its shoulder on the lid seat of the teapot, the appropriate quantity of tea leaves rest in the bottom of the infuser, and hot water permeates through the mesh wall so that the tea can be infused.

When the tea making is concluded, or earlier if desired, the infuser containing the wet spent tea leaves is removed and emptied for re-use.

The co-operating structure on the infuser and the pot body will be of a secure nature so that the pot can be handled for pouring without disturbing the infusing arrangements.

The invention will now be described by way of example and with reference to the accompanying informal sectional drawings.

Figure 1:
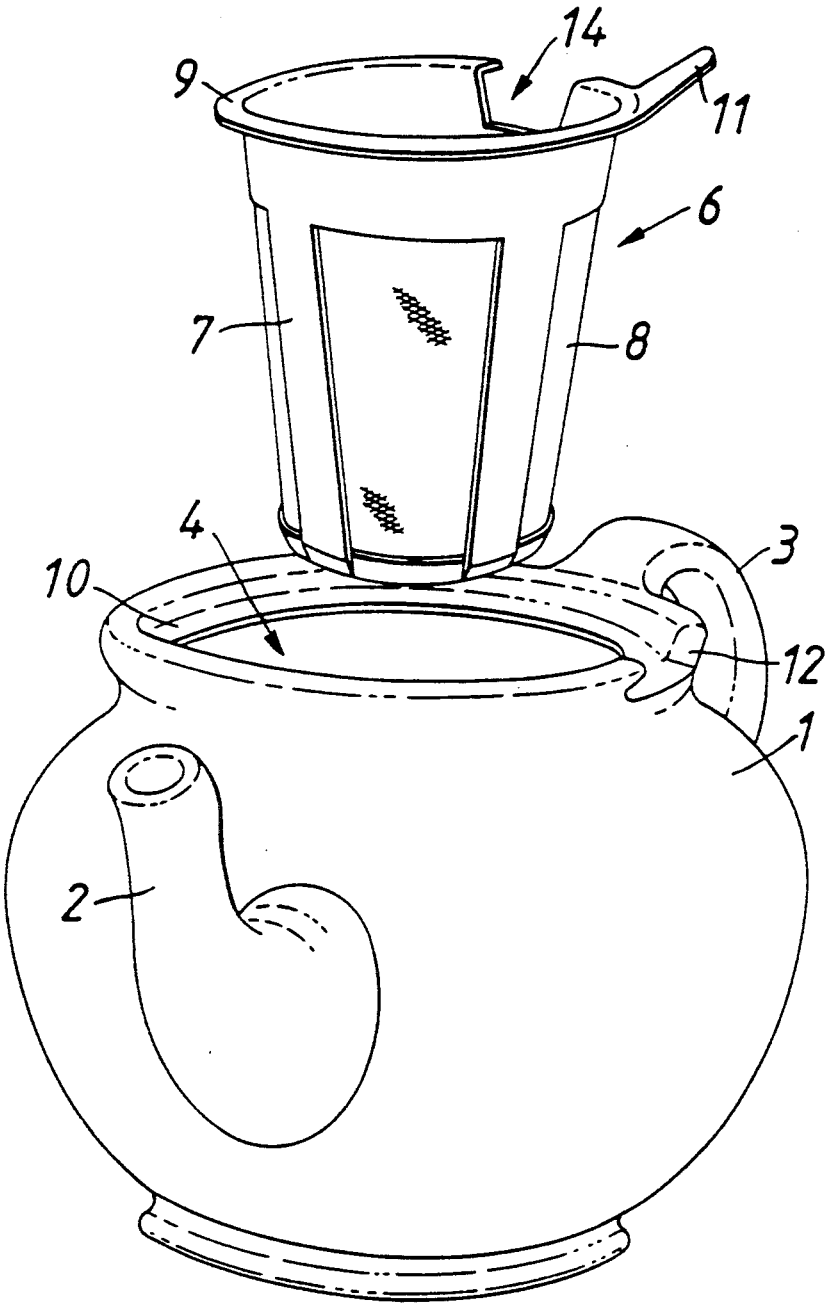
FIG. 1 is a perspective view of pot and infuser.
Figure 2:
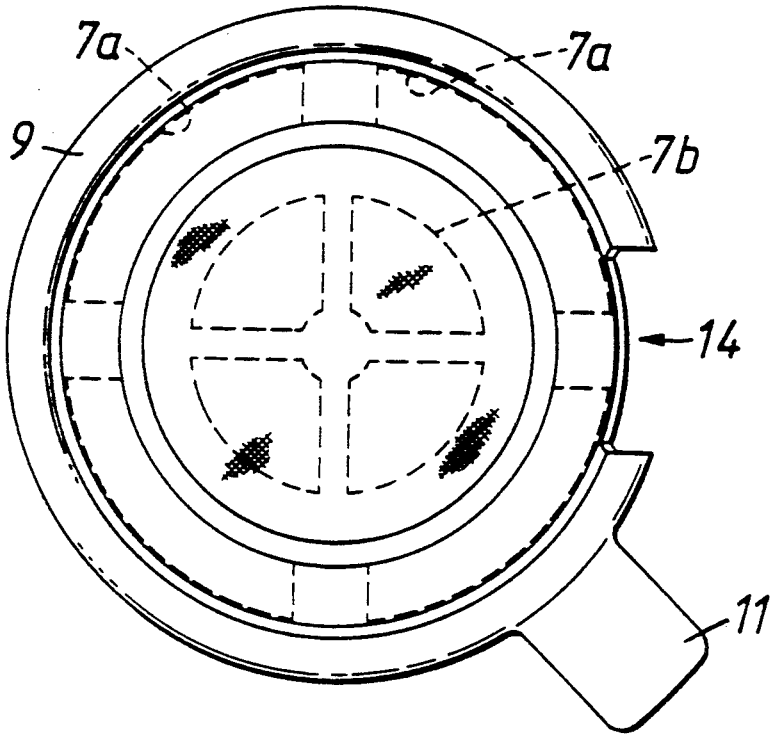
FIG. 2 is a plan view of the infuser.

FIG. 1 shows a tea pot having a body 1 of conventional part-spherical shape with a spout 2 and a handle 3. The pot has the usual generally circular opening 4 in the upper wall, this opening being closed by a removable lid 5 (shown in FIG. 3). A frusto-conically shaped infuser 6 consists of an injection moulded skeletal structure 7 of plastics material, which carries within openings 7*a* and 7*b* in the skeletal structure a porous wall 8 for confining loose beverage particles, particularly tea. The infuser is shaped so as to extend to the bottom region of the beverage pot so that tea will be carried at the lower part of the pot so that even when the pot has a small quantity of liquid therein the liquid will be able to satisfactorily infuse into the tea leaves. Also, the mesh covered openings in the skeletal structure are provided in both the side wall 7*a* and base 7*b* of the infuser to allow for efficient infusion in the base region (see FIG. 2).

The injection moulded skeletal structure 7 incorporates a shoulder 9 which is dimensioned so as to be able to rest on the lid seat 10 of the teapot. Extending outwardly from the shoulder 9 of the infuser is a handle 11. This is accommodated within a cutout 12 in the shoulder area of the teapot, and is to enable the infuser to be lifted out when necessary.

Figure 3:
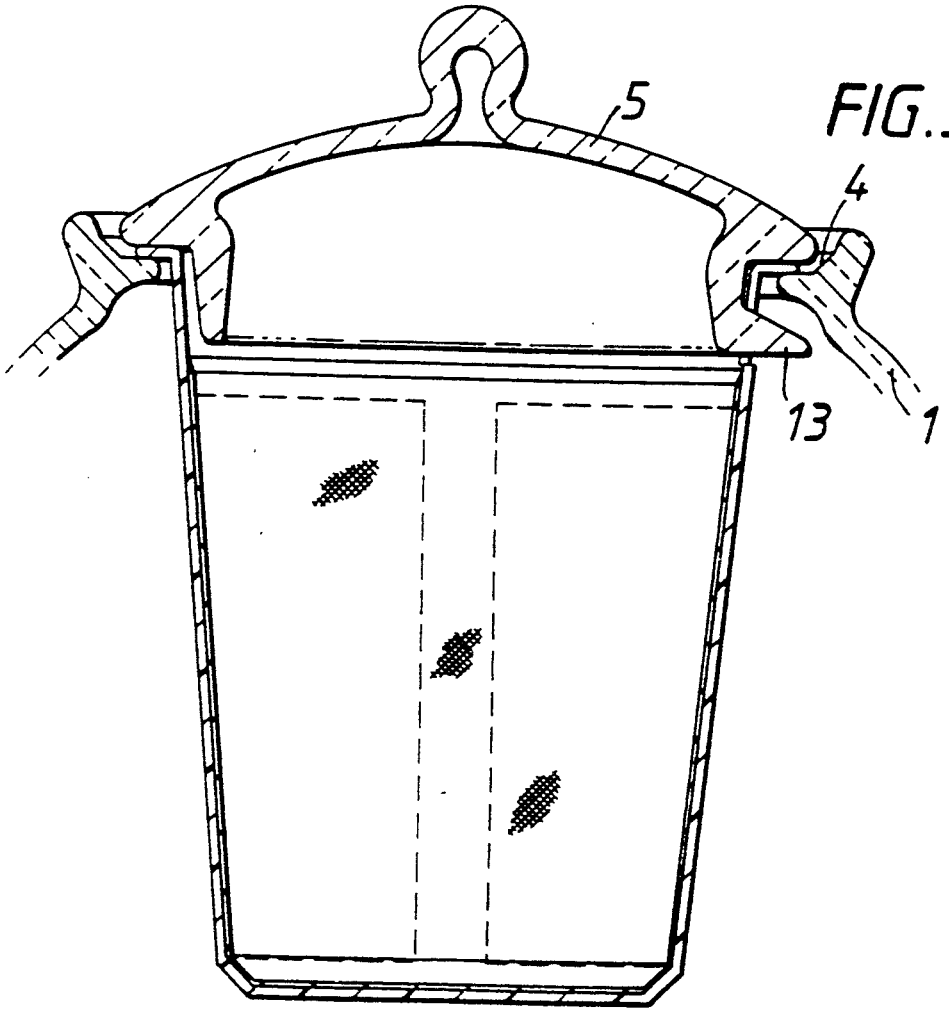
FIG. 3 is a sectional side elevation of the infuser in place.

Referring to FIG. 3 the lid of the teapot has a retaining tongue 13 which prevents the teapot lid from falling off during use, and the shoulder region of the infuser has a corresponding cutout 14 to accommodate the retaining tongue 13.

In use, the infuser rests with its shoulder on the lid seat of the teapot, the appropriate quantity of tea leaves rest in the bottom of the infuser, and hot water permeates through the mesh wall 8 so that the tea can be infused.

After use the infuser can simply be lifted out of the teapot, and the teapot itself remains clean without stain and does not need to have any form of filter wall incorporated in its own structure to prevent tea leaves passing out through the teapot and into the cups, when pouring out.

I claim:

1. A teapot for brewing and serving tea, comprising:

a body to hold hot tea and to permit the pouring of the tea therefrom and having a lid seat surrounding and defining a lid opening, a lid providing access to the interior of the body and seated on said lid seat, said lid having a radially extending retaining tongue which projects under the lid seat to prevent the lid from falling off during pouring, and a plastic infuser for holding tea leaves, said infuser having a shoulder resting on the lid seat, said infuser shoulder having a cutout to permit the retaining tongue of said lid to pass through said cutout to engage under the lid seat when the infuser and lid are placed on said lid seat, said infuser having an integral projecting handle extending out from the shoulder to permit the infuser to be lifted out of the pot, said infuser being removable after brewing and before pouring of the tea, said infuser being formed of a skeletal wall structure having openings therein, said skeletal wall structure carrying a porous material between said openings to form a porous wall and extending to the bottom region of the teapot to enable hot water in the lower region of the pot to pass through the porous material in order to contact tea leaves in the infuser to provide infusion and brew said tea.

2. A beverage pot according to claim 1 in which the infuser is formed of a frusto-conical shape.

* * * * *